United States Patent [19]

Henrich et al.

[11] Patent Number: 4,710,287

[45] Date of Patent: Dec. 1, 1987

[54] FIBROUS SUSPENSION PRESSURIZED SORTER

[75] Inventors: Hans-Otto Henrich; Reimund Rienecker, both of Heidenheim, Fed. Rep. of Germany

[73] Assignee: J. M. Voith GmbH, Heidenheim, Fed. Rep. of Germany

[21] Appl. No.: 865,424

[22] Filed: May 21, 1986

[30] Foreign Application Priority Data

May 30, 1985 [DE] Fed. Rep. of Germany ..... 3519373

[51] Int. Cl.[4] ..... B07B 1/20

[52] U.S. Cl. ..... 209/270; 209/306; 209/284

[58] Field of Search ..... 209/270, 279, 280, 283, 209/271, 273, 284, 285, 286, 302, 305, 306

[56] References Cited

U.S. PATENT DOCUMENTS

| | | | |
|---|---|---|---|
| 3,145,165 | 8/1964 | Sandison | 209/273 X |
| 3,786,918 | 1/1974 | Holz | 209/306 X |
| 4,126,513 | 11/1978 | Justus et al. | 209/306 X |
| 4,234,417 | 11/1980 | Gauld et al. | 209/273 X |
| 4,328,096 | 5/1982 | Chupka et al. | 209/273 X |
| 4,391,702 | 7/1983 | Murakani et al. | 209/270 X |
| 4,461,702 | 7/1984 | Furukawa | 209/305 X |
| 4,462,900 | 7/1984 | Matthew | 209/270 X |
| 4,493,766 | 1/1985 | Musselmann et al. | 209/273 X |

FOREIGN PATENT DOCUMENTS

| | | | |
|---|---|---|---|
| 2063516 | 12/1971 | Fed. Rep. of Germany | 209/273 |
| 1492209 | 12/1975 | United Kingdom . | |

*Primary Examiner*—David A. Scherbel
*Assistant Examiner*—Glenn B. Foster
*Attorney, Agent, or Firm*—Jeffers, Hoffman & Niewyk

[57] ABSTRACT

A sorter having a rotationally symmetric screen including a drain space for receiving overflow material (rejects) connected axially above the screen. A screen space is provided radially outside of the screen and an accepts drain space is connected to the screen space above the screen and surrounding the drain space. The screen space receives the flow through material (accepts) and, in its upper portion, includes a gas space for dampening.

6 Claims, 2 Drawing Figures

FIG. 1
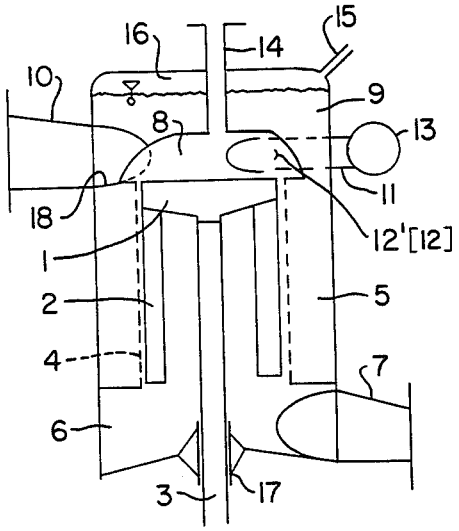
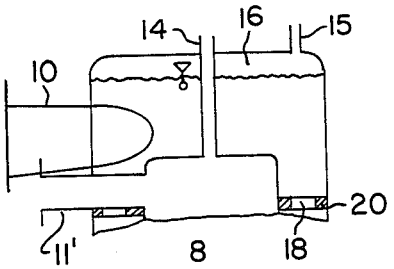
FIG. 2

FIBROUS SUSPENSION PRESSURIZED SORTER

BACKGROUND OF THE INVENTION

The present invention concerns a sorter for fibrous suspension having a rotationally symmetric screen and an accepts screen space on the screen outlet side which is located radially outside of the rotationally symmetric screen as is known from Patent GB No. 1,492,209. The present invented sorter features a dampening space with a gas pressure cushion in the upper housing area integral with the accepts screen space. The dampening space is specifically intended to dampen the pulsations in the suspension which are caused by the rotor and the rotating sorter elements attached to the rotor. The rotor and rotating sorter elements are arranged within the rotationally symmetric screen, also known as a screen basket, shortly before the head box of a paper machine.

In the sorter of GB No. 1,492,209, to obtain a dampening space within a maximally large cross section, the pulp inlet and the pump outlet have both been arranged at the bottom of the sorter housing. The drain for the overflow or the sorted fraction is located also at the bottom of the housing. In order to avoid excessive hampering of the sorting effect, and to obtain a reasonably acceptable sorting in GB No. 1,492,209, it was necessary to run the pump inlet centrally into the interior of the screen basket. Thus, the drive shaft for the rotor had to be run through the pulp inlet pipe. This design is in and of itself extremely disadvantageous. Further, another drawback remains in that the sorting effect is not satisfactory due to the bottom location of the two connections for the inflow and the draining of the overflow. Attempts have been made to correct this ineffective sorting through specific cross section ratios of the pipelines and/or feed and drain openings. However, these design modifications have proved unsatisfactory.

Accordingly, the problem underlying the invention is to design a sorter having a dampening space and so that the sorting effect will not be adversely affected. A further problem underlying the invention is to, as far as possible, provide a sorter, which at the same time, has an improved dampening performance.

SUMMARY OF THE INVENTION

The object of the present invention is to solve the problems of prior art sorters so as to provide a sorter with a dampening space which also provides effective sorting and improved dampening.

The objects of the invention are generally solved by providing a rotationally symmetric screen and an accepts screen space on the screen outlet side radially outside of the symmetric screen. A central drain space is connected to the interior of the screen so as to receive overflow material, and an accepts drain space surrounding the central drain space is connected to the accepts screen space for receiving flow through material. A gas space in the upper part of the accepts drain is provided for dampening. An outlet connected to the accepts drain space is provided as an outlet for the flow through material, and an inlet is located on the other axial end of the screen, opposite the central drain space, for receiving fibrous suspensions.

Unlike the prior embodiment of GB No. 1,492,209 in the present invention, a screen space for accepted stock is first provided radially outside the screen basket integral, in an axial direction above the screen basket, with the accepted stock collecting space. From this accepted stock collecting space originates the accepts outlet. Pulsations caused by the rotating sorter elements thus must propagate first in the screen space whereat they are partially dampened and/or equalized. The dampening performance is further improved by the additional choking cross section arranged between the screen space and the accepts space. The tailing collecting space or the outlet for the overflow and the pulp inlet are located at axially opposite ends of the screen basket so that the sorting effect can be maximized.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein:

FIG. 1 is a cross-sectional elevational view of a sorter according to the present invention;

FIG. 2 is a cross-sectional elevational view showing a different embodiment of the sorter shown in FIG. 1.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF A SPECIFIC EMBODIMENT

The invention will be explained hereafter with the aid of two embodiments illustrated in FIGS. 1 and 2 respectively of the drawings.

The sorter presented in FIG. 1 features a rotor 1 whose sorter elements 2 extend parallel to the shaft 3 of the rotor. Shaft 3 enters the sorter through sealing bearing portion 17. Sorter elements 2 are arranged to pass closely along the inner portion of rotationally symmetric screen basket 4. As shown in FIG. 1, rotor 1 has two arms upon which sorter elements 2 are each mounted. Other suitable rotors are those with a drum-type structure where various numerous sections of sorter elements 2 are located between the shell of the drum and screen basket 4.

Screen basket 4 is surrounded by an accepts screen space 5 in which the accepted stock accumulates. Pulp feeding into the space within screen basket 4 where rotor 1 is located proceeds therein by way of feed space 6 which is located below screen basket 4. Pulp enters space 6 through tangential inlet 7 again located below screen basket 4.

Above rotor 1 there is located accepts drain space 9 which is integral with accepts screen space 5. In the embodiment shown in FIG. 1, constriction point 18 is provided at the transition area between screen space 5 and accepts drain space 9. Constriction point 18 provides further dampening of the pulsations caused by sorter elements 2.

The unsortable share of suspension i.e., the overflow proceeds into central drain space 8. Originating from drain space 8 and connected thereto are lines 11. More specifically, lines 11 are connected to outlet openings 12 and 12' of drain space 8. As shown in FIG. 1, drain lines 11 may be combined in a single collecting pipe 13.

Extending centrally upwardly from drain space 8 is pipe 14. Pipe 14 is provided for ventilation but may likewise serve also for the removal of light contaminants. Additionally, if necessary, the entire overflow may be removed from drain space 8 through drain pipe 14. Tailing drain pipe 14 has an appropriately large diameter for this purpose.

In the upper part of accepts space 9, there is provided a gas cushion 16 which, for example, may be air or nitrogen. Pressure control line 15 is connected to gas cushion area or space 16. Further, control line 15 makes it possible to regulate the gas cushion pressure according to the average pressure prevailing in the sorter or according to particular head box requirements.

It should be noted that the sorter experiences pulsations caused both by proceding pumps pushing the pulp into the sorter and by sorter elements 2. In operation, these pulsations are dampened via accepts space 5. Pulsations which propagate beyond accepts space 5 are very effectively dampened by gas pressure cushion 16. Outlet socket 10 is connected to the accepts space 9 preferably tangentially. Outlet socket 10 could yet be moved somewhat upwardly in order to then arrange drain socket 11 for the overflow on the same sorter side as the accepts drain socket 10.

The cross-sectional area ratio between the cross section of the outlet opening of accepts drain socket 10 and the annular area of accepts space 9 is relatively small amounting here to about 1:12. It should be understood, however, that ratios of 1:8 or 1:10 will also produce a reasonably satisfactory result.

Drain socket 10 is preferably shaped in a conical design flaring outwardly.

In a different embodiment, as shown in FIG. 2, constriction 18, unlike that shown in FIG. 1 where the constriction is made by providing a diameter in the lower part of overflow drain space 8 relatively larger in relation to the diameter of screen 4, can be provided by a perforated annular plate 20. Further, as shown in the embodiment of FIG. 2, drain line 11', for the overflow, is connected in the same area of the drain line for the flow through (accepts), and it can be seen that the required overall height in this embodiment of the sorter is somewhat greater relative to the embodiment of FIG. 1.

The integrated dampener design of the present invention offers the advantages that no additional apparatus is necessary and the sorter itself is essentially not enlarged in diameter and at the most, requires some additional overall height, while providing effective sorting and improved dampening. Further, the sorter of the present invention is relatively inexpensive to manufacture and operate.

While the invention has been described as having specific embodiments, it will be understood that it is capable of further modifications. This application is, therefore, intended to cover variations, uses, or adaptations of the invention following the general principles thereof, and including such departures from the present disclosure as come within known or customary practice in the art to which this invention pertains and fall within the limits of the appended claims.

What is claimed is:

1. A sorter for fibrous suspensions comprising:

a rotationally symmetric vertically oriented screen mounted in said sorter, said screen defining an interior side and a screen outlet side radially outside said screen;

an accepts screen space on said screen outlet side;

a central drain space connected to the interior of said screen for receiving overflow material;

an accepts drain space at an axial end of said screen surrounding said central drain space, which accepts drain space has an upper part;

a constricted connection communicating between said accepts drain space and said accepts screen space, which accepts drain space receives flow through material from said accepts screen space;

a pressurized gas space in the upper part of said accepts drain space;

an outlet connected to said accepts drain space for receiving the flow through material; and an inlet for the suspension located on the other axial end of said screen opposite said central drain space for receiving fibrous suspensions.

2. The sorter according to claim 1 further comprising a rotor having a shaft and sorter elements, said rotor coaxial within said screen and said sorter elements generating pulsations within the fibrous suspensions.

3. The sorter as claimed in claim 2, wherein said accepts screen space and said gas space are operable to dampen said pulsations and said constricted connection forms a choking point to further dampen said pulsations.

4. The sorter according to claim 1 further comprising a tailing drain pipe connected to said central drain space extending outwardly centrally therefrom through said accepts drain space.

5. The sorter according to claim 1 further comprising a gas control line connected to said gas space.

6. The sorter according to claim 1 further comprising an drain socket connected to said outlet, said socket having a conic outwardly flared shape.

* * * * *

UNITED STATES PATENT AND TRADEMARK OFFICE

CERTIFICATE OF CORRECTION

PATENT NO. : 4,710,287

DATED : December 1, 1987

INVENTOR(S) : Hans-Otto Henrich et al

It is certified that error appears in the above-identified patent and that said Letters Patent is hereby corrected as shown below:

Claim 6, Col. 4, line 51, after "an" insert --accepts--.

Signed and Sealed this

Tenth Day of May, 1988

*Attest:*

*Attesting Officer*

DONALD J. QUIGG

*Commissioner of Patents and Trademarks*